US012753942B2

(12) United States Patent
Smith et al.

(10) Patent No.: US 12,753,942 B2
(45) Date of Patent: Oct. 6, 2026

(54) ADJUSTABLE WORKING FLUID RESERVOIR FOR HVAC SYSTEM

(71) Applicant: Johnson Controls Tyco IP Holdings LLP, Milwaukee, WI (US)

(72) Inventors: Jeremy Ryan Smith, Park City, KS (US); Shawn Alex Hern, Wichita, KS (US); Tyler McCune, Wichita, KS (US); Aneek Muhammad Noor, Wichita, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 5 days.

(21) Appl. No.: 18/136,778

(22) Filed: Apr. 19, 2023

(65) Prior Publication Data

US 2024/0353142 A1 Oct. 24, 2024

(51) Int. Cl.
*F24F 11/83* (2018.01)
*F24F 1/0068* (2019.01)

(52) U.S. Cl.
CPC ..... *F24F 11/83* (2018.01); *F24F 1/0068* (2019.02); *F25B 2400/051* (2013.01); *F25B 2400/053* (2013.01); *F25B 2500/23* (2013.01); *F25B 2500/24* (2013.01); *F25B 2600/05* (2013.01)

(58) Field of Classification Search
None
See application file for complete search history.

(56) References Cited

U.S. PATENT DOCUMENTS

| | | | | |
|---|---|---|---|---|
| 5,497,631 | A * | 3/1996 | Lorentzen | F25B 45/00 62/174 |
| 5,611,211 | A * | 3/1997 | Whipple, III | F25B 45/00 62/149 |
| 7,096,679 | B2 | 8/2006 | Manole | |
| 9,976,785 | B2 | 5/2018 | Goel et al. | |
| 10,488,089 | B2 | 11/2019 | Kester et al. | |
| 2010/0251742 | A1 | 10/2010 | Tucker et al. | |
| 2015/0266358 | A1 * | 9/2015 | Rebinger | B60H 1/3219 62/174 |

(Continued)

FOREIGN PATENT DOCUMENTS

JP 6274909 B2 2/2018

OTHER PUBLICATIONS

"Motor" definition retrieved from The American Heritage Dictionary of the English Language at https://ahdictionary.com/word/search.html?q=motors%27 on Dec. 10, 2024.*

*Primary Examiner* — Jerry-Daryl Fletcher
*Assistant Examiner* — Daniel C Comings
(74) *Attorney, Agent, or Firm* — Fletcher Yoder, P.C.

(57) ABSTRACT

A heating, ventilation, and air conditioning (HVAC) system includes a working fluid reservoir having an enclosure defining a chamber configured to fluidly couple to a working fluid circuit, where the chamber is configured to receive and store working fluid from the working fluid circuit. The HVAC system also includes an actuator configured to adjust a component disposed within the enclosure to adjust a volume of the chamber and a control system configured to instruct the actuator to adjust a position of the component disposed within the enclosure to increase the volume of the chamber, to reduce the volume of the chamber, or both based on an operating mode of the HVAC system.

18 Claims, 8 Drawing Sheets

(56) References Cited

U.S. PATENT DOCUMENTS

| | | | | |
|---|---|---|---|---|
| 2016/0238292 | A1* | 8/2016 | Andrews | B60H 1/3229 |
| 2019/0368784 | A1* | 12/2019 | Zha | F25B 5/00 |
| 2021/0215410 | A1* | 7/2021 | Zha | F25D 11/022 |
| 2023/0123900 | A1* | 4/2023 | Hoysall | F25B 45/00 62/115 |
| 2023/0125880 | A1* | 4/2023 | Analytis | F24F 11/523 236/1 C |

* cited by examiner

ADJUSTABLE WORKING FLUID RESERVOIR FOR HVAC SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties by conditioning a supply air flow delivered to the environment. For example, the HVAC system may place the supply air flow in a heat exchange relationship with a working fluid of a vapor compression circuit to condition the supply air flow. It may be desirable to change an amount of working fluid circulating through the vapor compression circuit to achieve a target performance, such as an efficiency, of the HVAC system. As an example, different operating modes, such as a heating mode and a cooling mode, may utilize different amounts of working fluid flow through the vapor compression circuit, which may impact performance of the HVAC system.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and air conditioning (HVAC) system includes a working fluid reservoir having an enclosure defining a chamber configured to fluidly couple to a working fluid circuit, where the chamber is configured to receive and store working fluid from the working fluid circuit. The HVAC system also includes an actuator configured to adjust a component disposed within the enclosure to adjust a volume of the chamber and a control system configured to instruct the actuator to adjust a position of the component disposed within the enclosure to increase the volume of the chamber, to reduce the volume of the chamber, or both based on an operating mode of the HVAC system.

In another embodiment, a heating, ventilation, and air conditioning (HVAC) system includes a working fluid reservoir having an enclosure and a component disposed within the enclosure, where the enclosure defines a chamber configured to fluidly couple to a working fluid circuit of the HVAC system and to receive and store working fluid from the working fluid circuit, and where the component is adjustable within the chamber to adjust a volume of the chamber. The HVAC system also includes a control system configured to instruct an actuator to move the component within the enclosure to reduce the volume of the chamber in a cooling mode of the HVAC system and to instruct the actuator to move the component within the enclosure to increase the volume of the chamber in a heating mode of the HVAC system.

In a further embodiment, a non-transitory computer-readable medium, includes instructions that, when executed by processing circuitry, are configured to cause the processing circuitry to determine an operating mode of a heating, ventilation, and air conditioning (HVAC) system, where the HVAC system includes a working fluid circuit configured to circulate working fluid therethrough, and to instruct an actuator to adjust a position of a component disposed within an enclosure of a working fluid reservoir of the HVAC system based on the operating mode to adjust a volume of a chamber defined by the enclosure, wherein the chamber is fluidly coupled to the working fluid circuit, and the volume of the chamber is configured to receive and store working fluid from the working fluid circuit.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
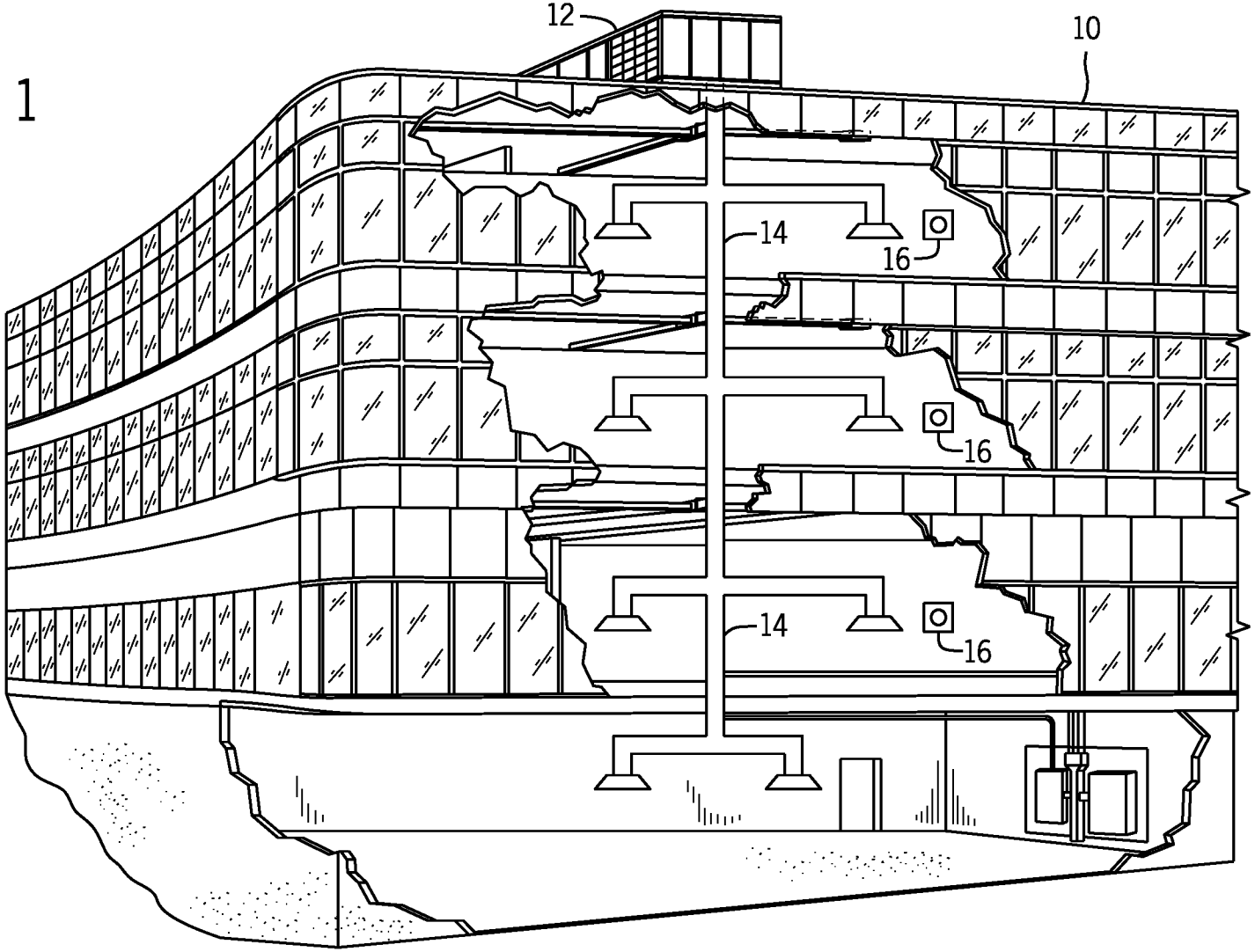
FIG. 1 is a perspective view of an embodiment of a heating, ventilation, and air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

The present disclosure is directed to a heating, ventilation, and air conditioning (HVAC) system configured to thermally regulate a space within a building, home, or other suitable structure. For example, the HVAC system may include a vapor compression system that transfers thermal energy between a working fluid (e.g., a refrigerant) and a fluid to be conditioned, such as air. The vapor compression system may include a compressor used to circulate the working fluid through conduits and other components (e.g., an expansion device) of a working fluid circuit. The vapor compression system may also include heat exchangers (e.g., a condenser, an evaporator) that enables transfer of thermal energy between the working fluid and an additional fluid (e.g., an air flow). In some embodiments, the HVAC system may be a heat pump (e.g., a heat pump system) having a first heat exchanger (e.g., a heating and/or cooling coil, an indoor coil, an evaporator) and a second heat exchanger (e.g., a heating and/or cooling coil, an outdoor coil, a condenser). The first heat exchanger may place the working fluid in a heat exchange relationship with a first air flow (e.g., an ambient air flow, an environmental air flow) to condition the working fluid. The second heat exchanger may place the working fluid in a heat exchange relationship with a second air flow (e.g., a supply air flow, a return air flow) to condition the second air flow, and the second air flow may be supplied to a conditioned space. The compressor may circulate the working fluid between the first heat exchanger and the second heat exchanger to enable heat transfer between the space and an ambient environment, for example.

The heat pump may be operable to provide both cooling and heating to the space to be conditioned (e.g., a room, zone, or other region within a building) by adjusting a flow of working fluid through the working fluid circuit. For example, during operation of the heat pump in a cooling mode, the compressor may direct working fluid through the working fluid circuit and the first and second heat exchangers in a first flow direction. The first heat exchanger may receive working fluid pressurized and discharged by the compressor, and the first heat exchanger may operate as a condenser to reject the heat from the working fluid (e.g., to an ambient air flow directed across the first heat exchanger), thereby cooling the working fluid. The first heat exchanger may direct the cooled working fluid to the second heat exchanger, which may operate as an evaporator and enable working fluid flowing through the second heat exchanger to absorb thermal energy from a supply air flow that is directed to the space, thereby cooling the space.

Conversely, during operation in a heating mode, a reversing valve (e.g., a switch-over valve) of the working fluid circuit enables the compressor to direct working fluid through the working fluid circuit and the first and second heat exchangers in a second flow direction. The second heat exchanger may receive working fluid pressurized and discharged by the compressor, and the second heat exchanger may operate as a condenser. That is, the second heat exchanger may receive the working fluid and reject heat to the space, thereby heating the space and cooling the working fluid. The first heat exchanger may operate as an evaporator by receiving the cooled working fluid and heating the working fluid (e.g., via the ambient air flow directed across the first heat exchanger).

Unfortunately, HVAC systems may be susceptible to operational inefficiencies in certain conditions or circumstances. As an example, an amount of working fluid circulating the working fluid circuit may be ill-suited and/or inefficient for certain HVAC system operations. For instance, the respective capacities of the first heat exchanger and the second heat exchanger may be different from one another in a heat pump. In some embodiments, the second heat exchanger may have a smaller capacity than that of the first heat exchanger. Thus, the first heat exchanger may be configured to receive working fluid from the compressor (e.g., in the cooling mode) at a greater flow rate than that in which the second heat exchanger may be configured to receive the working fluid from the compressor (e.g., in the heating mode). Circulating the same amount of working fluid through the working fluid circuit in both the cooling mode and the heating mode may cause each of the first heat exchanger and the second heat exchanger to receive approximately the same flow rate (e.g., mass flow rate, amount) of working fluid from the compressor in the corresponding cooling mode and heating mode. However, directing approximately the same flow rate of working fluid from the compressor to the first heat exchanger or to the second heat exchanger in the corresponding cooling mode and heating mode may reduce efficiency of the heat exchangers, such as operation of the first heat exchanger to enable heat transfer between the working fluid and an additional fluid and/or operation of the second heat exchanger to enable heat transfer between the working fluid and a supply air flow. Indeed, circulating an undesirable amount of working fluid in the HVAC system (e.g., the same amount of working fluid in the cooling mode and in the heating mode) may reduce efficiency of the HVAC system.

Thus, it is presently recognized that adjusting the amount of working fluid circulating through the working fluid circuit may improve operation of the HVAC system. Accordingly, embodiments of the present disclosure relate to an HVAC system that includes a reservoir configured to receive and store working fluid from the working fluid circuit to change the amount of working fluid circulating through the working fluid circuit. The reservoir may include an enclosure and a component positioned within the enclosure. The enclosure may define a chamber having a volume configured to receive and store working fluid from the working fluid circuit, and the component may be movable within the chamber to adjust the volume of the chamber, thereby changing an amount of working fluid that may be received and stored in the reservoir. For instance, adjusting a position of the component to reduce the volume of the chamber may reduce the amount of working fluid stored in the reservoir, thereby increasing the amount of working fluid circulating through the working fluid circuit. Adjusting the position of the component to increase the volume of the chamber may increase the amount of working fluid stored in the reservoir, thereby reducing the amount of working fluid circulating through the working fluid circuit. In this way, present embodiments enable dynamic adjustment to a charge or amount of working fluid circulated through the working fluid circuit.

A control system of the HVAC system may operate to adjust a position of the component to adjust the volume of the chamber. The control system may adjust the position of the component within the enclosure based on an operating parameter (e.g., a detected operating parameter). In some embodiments, the operating parameter may indicate an operating mode of the HVAC system. For example, the control system may adjust the position of the component to reduce the volume of the chamber in the cooling mode of the HVAC system. The control system may also adjust the position of the component to increase the volume of the chamber in the heating mode of the HVAC system. In additional or alternative embodiments, the control system may determine or calculate an efficiency of the HVAC system based on a detected operating parameter and adjust the position of the component based on the efficiency. In further embodiments, the control system may determine a target amount of working fluid circulating through the working fluid circuit and adjust the position of the component based on the target amount of working fluid. Adjustment of the position of the component may enable a more suitable amount of working fluid to circulate through the working fluid circuit, thereby enabling the HVAC system to operate more efficiently.

Turning now to the drawings, FIG. 1 illustrates an embodiment of a heating, ventilation, and air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
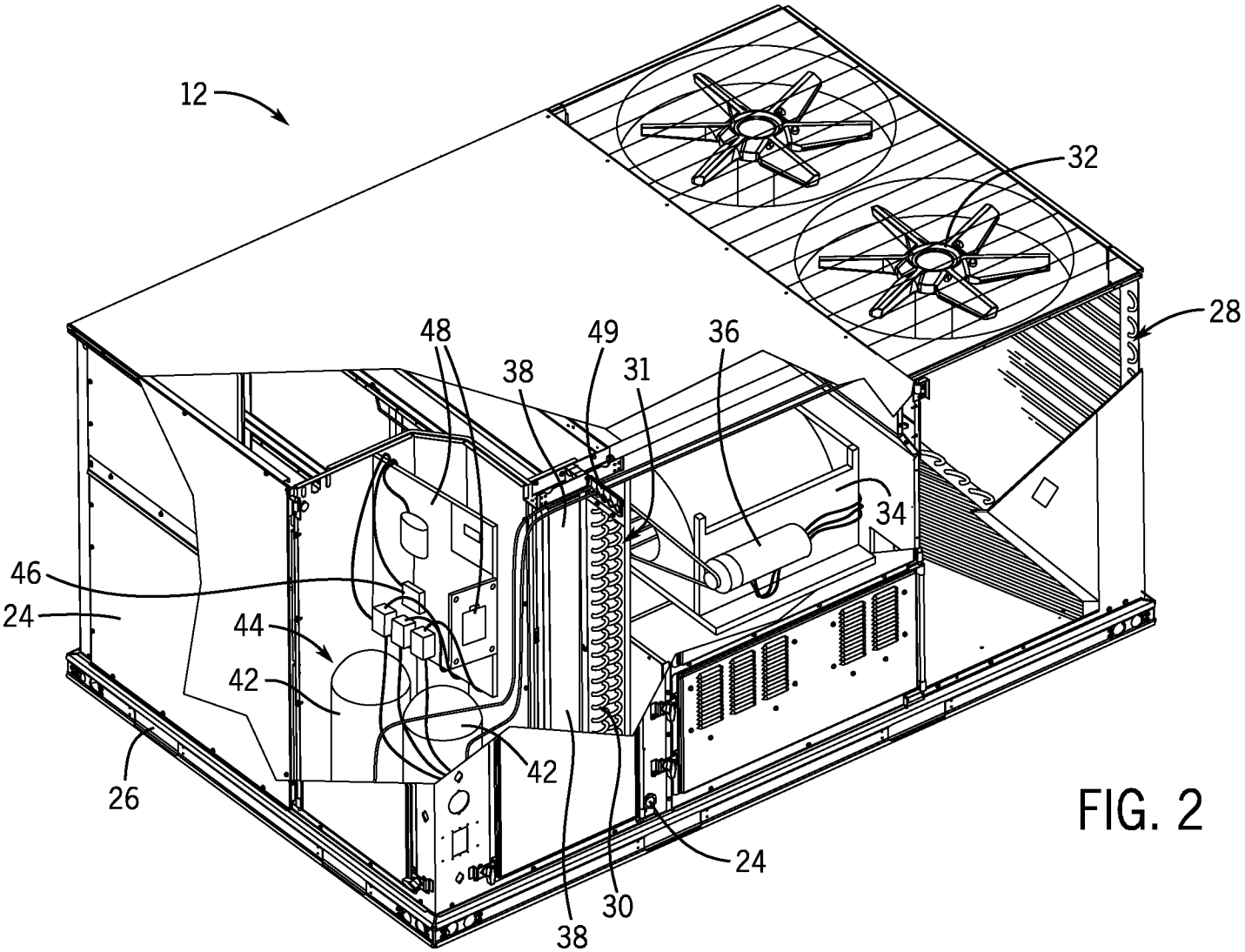
FIG. 2 is a perspective view of an embodiment of a packaged HVAC unit that may be used in an HVAC system, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
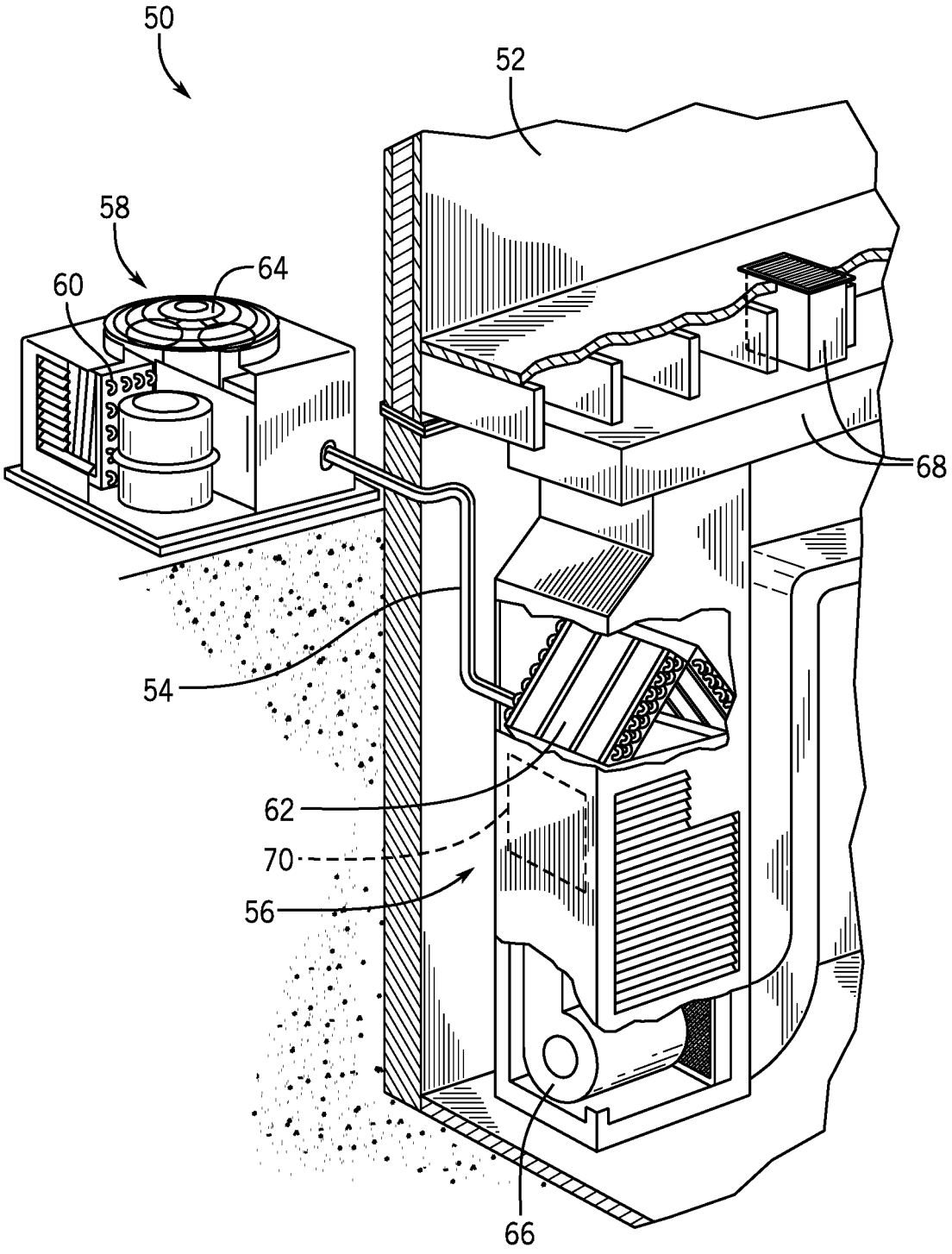
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
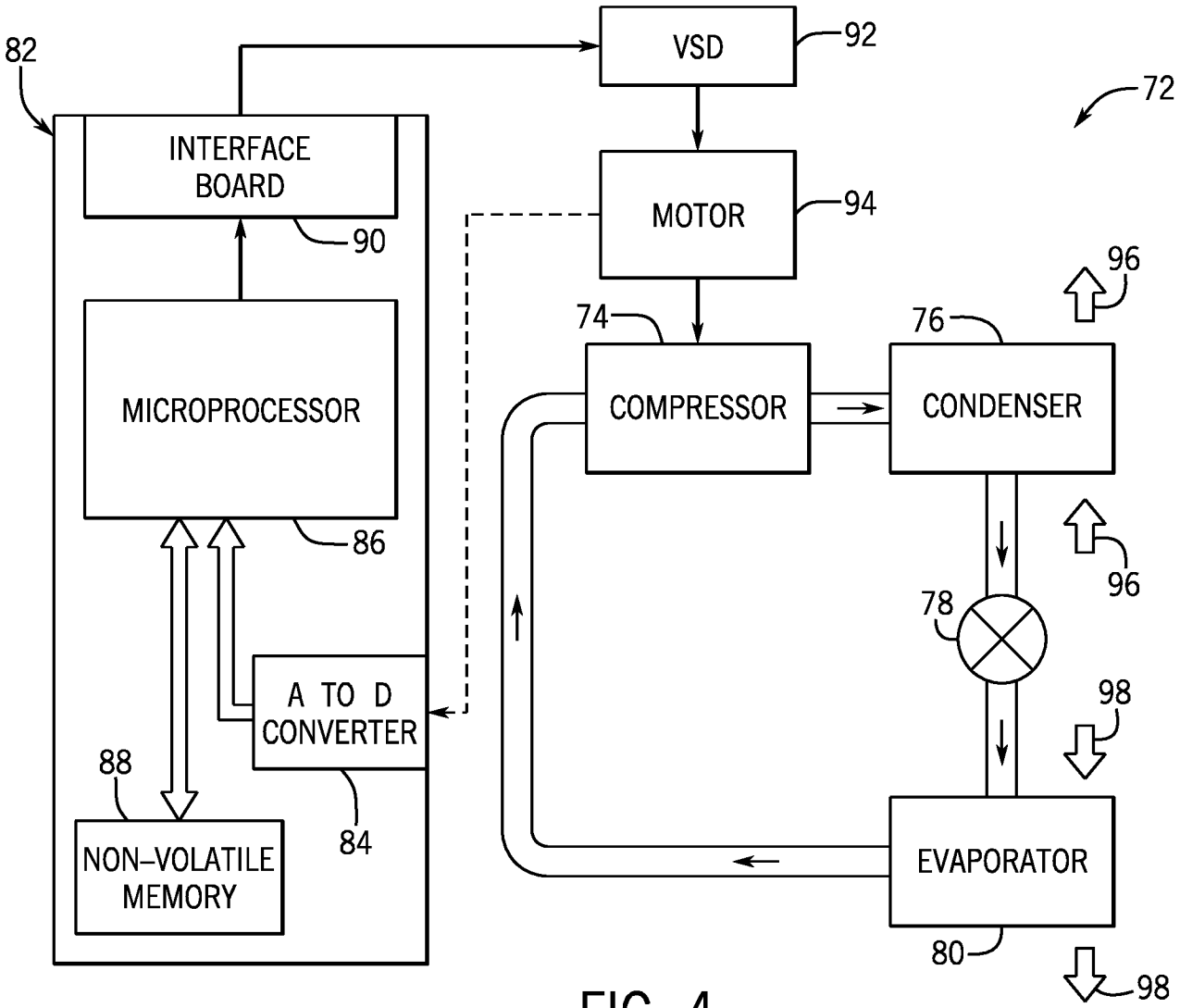
FIG. 4 is a schematic diagram of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to an HVAC system that includes a reservoir having an enclosure, which defines a chamber configured to receive and store working fluid from a working fluid circuit. The reservoir includes a component disposed within the enclosure, and the component is adjustable within the enclosure to adjust a volume of the chamber, thereby adjusting an amount of working fluid that may be stored in the chamber. For example, a control system of the HVAC system may adjust the position of the component based on an operating parameter to change the amount of working fluid stored in the chamber (e.g., based on an operating mode of the HVAC system). Accordingly, an amount of working fluid circulating through the working fluid circuit may also be changed. For example, the control system may adjust the position of the component to enable a more suitable amount of working fluid to circulate through the refrigerant circuit to enable the HVAC system to operate more efficiently.

Figure 5:
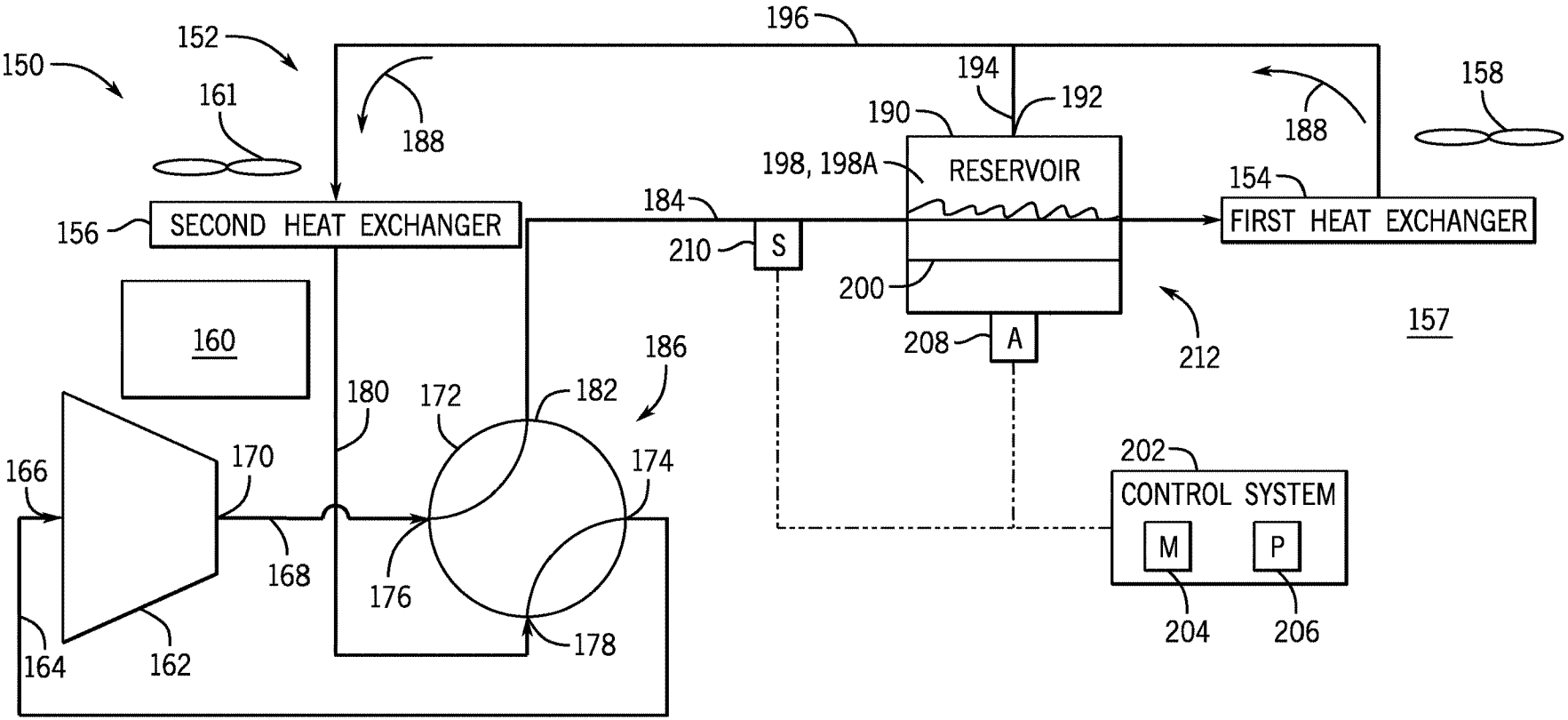
FIG. 5 is a schematic diagram of an embodiment of an HVAC system operating in a cooling mode and illustrating a working fluid reservoir of the HVAC system, in accordance with an aspect of the present disclosure.

With this in mind, FIG. 5 is a schematic diagram of an embodiment of an HVAC system 150 that includes a working fluid circuit 152 (e.g., refrigerant circuit) through which working fluid may be circulated. The working fluid circuit 152 may include various components, such as piping, tubing, conduits, valves, and so forth, that fluidly couple other HVAC system 150 components to one another. The HVAC system 150 may include one or more components of the vapor compression system 72 discussed above and/or may be included in any of the systems described above (e.g., the HVAC unit 12, the heating and cooling system 50). For example, the HVAC system 150 may include a first heat exchanger 154 and a second heat exchanger 156 that are fluidly coupled to one another via the working fluid circuit 152. The first heat exchanger 154 may be in thermal communication with an ambient environment 157 (e.g., an outdoor environment, an external environment). For example, a first fan 158 (e.g., a blower) may be configured to direct a first air flow across the first heat exchanger 154 to facilitate heat exchange between working fluid within the first heat exchanger 154 and the ambient environment 157. The second heat exchanger 156 may be in thermal communication with a thermal load 160 (e.g., a room, space, and/or device) serviced by the HVAC system 150. A second fan 161 (e.g., a blower) may direct a second air flow across the second heat exchanger 156 to facilitate heat exchange between working fluid within the second heat exchanger 156 and the thermal load 160.

The HVAC system 150 may also include a compressor 162 (e.g., a compressor system) disposed along the working fluid circuit 152. The compressor 162 is configured to direct working fluid flow through the first heat exchanger 154, the second heat exchanger 156, and remaining components that may be fluidly coupled to the working fluid circuit 152. Although a single compressor 162 is shown in the illustrated embodiment, the HVAC system 150 may include any suitable quantity of compressors 162, such as two, three, four, five, six, or more than six compressors 162. The compressor 162 may include a fixed speed compressor, a multi-stage (e.g., two stage) compressor, and/or a variable speed compressor. Additionally, the compressor 162 may include a rotary compressor, a scroll compressor, or any other suitable type of compressor. The compressor 162 is configured to receive working fluid (e.g., a primary flow of working fluid) via a suction conduit 164 fluidly coupled to a suction port 166 of the compressor 162 and to discharge working fluid (e.g., compressed working fluid) via a discharge conduit 168 fluidly coupled to a discharge port 170 of the compressor 162.

The HVAC system 150 may be a heat pump (e.g., a heat pump system) in which the compressor 162 may be fluidly coupled to a remainder of the working fluid circuit 152 via a reversing valve 172 (e.g., a switch-over valve). In the illustrated embodiment, the reversing valve 172 includes a first port 174 that is fluidly coupled to the suction conduit 164, a second port 176 that is fluidly coupled to the discharge conduit 168, a third port 178 that is fluidly coupled to a first conduit portion 180 extending to the second heat exchanger 156, and a fourth port 182 that is fluidly coupled to a second conduit portion 184 extending to the first heat exchanger 154.

The HVAC system 150 may operate in various operating modes by adjusting a configuration of the reversing valve 172. For example, in the illustrated embodiment, the reversing valve 172 is in a first configuration 186 in which the first port 174 and the third port 178 are fluidly coupled to one another and the second port 176 and the fourth port 182 are fluidly coupled to one another. Accordingly, in the first configuration 186, the reversing valve 172 enables the compressor 162 to receive a flow of working fluid from the second heat exchanger 156 and to discharge a flow of working fluid to the first heat exchanger 154. As such, while the reversing valve 172 is in the first configuration 186, the compressor 162 may direct a working fluid flow along at least a portion of the working fluid circuit 152 in a first flow direction 188. The HVAC system 150 may operate in a cooling mode with the reversing valve 172 in the first configuration 186. For instance, the first configuration 186 of the reversing valve 172 may enable the first heat exchanger 154 to cool the working fluid received from the compressor 162 (e.g., via the air flow directed by the first fan 158 across the first heat exchanger 154) and direct the cooled working fluid to the second heat exchanger 156. The second heat exchanger 156 may then enable the cooled working fluid to provide cooling for the thermal load 160 (e.g., via the air flow directed by the second fan 161 across the second heat exchanger 156).

The HVAC system 150 may also include a working fluid reservoir 190 (e.g., a compensator) configured to enable adjustable control of an amount of working fluid (e.g., liquid working fluid) circulating through the working fluid circuit 152. For example, the working fluid reservoir 190 may define a chamber that is fluidly coupled to the working fluid circuit 152, and the chamber may be configured to receive and store a portion of working fluid received from the working fluid circuit 152. Thus, the portion of working fluid stored in the reservoir 190 may not circulate through the working fluid circuit 152. As an example, a port 192 (e.g., an inlet port, an outlet port, a collection port) of the working fluid reservoir 190 may be fluidly coupled to a reservoir conduit 194 (e.g., a working fluid liquid line, a working fluid vapor line), and the reservoir conduit 194 may be fluidly coupled to a third conduit portion 196 of the working fluid circuit 152 that extends between the first heat exchanger 154 and the second heat exchanger 156. That is, in the cooling mode of the HVAC system 150, in which the reversing valve 172 is in the first configuration 186, the working fluid reservoir 190 may be fluidly coupled to the working fluid circuit 152 via the third conduit portion 196 downstream of the first heat exchanger 154 and upstream of the second heat exchanger 156 with respect to a flow of working fluid from the first heat exchanger 154 to the second heat exchanger 156.

The reservoir conduit 194 may enable working fluid flow between the working fluid circuit 152 (e.g., the third conduit portion 196) and the working fluid reservoir 190. In some embodiments, the second conduit portion 184 may extend through the working fluid reservoir 190 and place working fluid directed through the second conduit portion 184 in a heat exchange relationship with working fluid stored in the working fluid reservoir 190 to urge working fluid flow between the working fluid circuit 152 and the working fluid reservoir 190 via the reservoir conduit 194. For example, in the cooling mode, the second conduit portion 184 may receive heated working fluid pressurized by the compressor 162. The heated working fluid may heat working fluid stored in the working fluid reservoir 190, thereby increasing a pressure within the working fluid reservoir 190. The increased pressure within the working fluid reservoir 190 may urge working fluid flow out of the working fluid reservoir 190 via the port 192, through the reservoir conduit 194, and to the third conduit portion 196 to flow into the working fluid circuit 152. As such, in the cooling mode, relatively less working fluid may be stored in the working fluid reservoir 190 and relatively more working fluid may circulate through the working fluid circuit 152.

The relatively increased working fluid flow through the working fluid circuit 152 may enable the HVAC system 150 to achieve a desirable performance, such as a desirable efficiency, in the cooling mode. As an example, the first heat exchanger 154 may have a relatively high capacity and may therefore be configured to receive working fluid a relatively greater flow rate from the compressor 162 and therefore accommodate a relatively high amount of working fluid directed through the working fluid circuit 152. The increased amount of working fluid may enable the compressor 162 to discharge the working fluid at a desirable flow rate (e.g., above a threshold flow rate) to the first heat exchanger 154 to cool the working fluid and increase a cooling capacity of the HVAC system 150, thereby increasing efficiency of the HVAC system 150.

Additionally, in accordance with techniques, a volume 198 (e.g., a size of the volume 198) of the chamber defined by the working fluid reservoir 190 may be adjusted to further adjust an amount of working fluid that may flow into the working fluid reservoir 190, and thereby adjust the amount of working fluid circulating through the HVAC system 150. For example, in the cooling mode, the volume 198 of the chamber defined by the working fluid reservoir 190 may be reduced, thereby further urging flow of working fluid from the working fluid reservoir 190 to the working fluid circuit 152. In some embodiments, the working fluid reservoir 190 may include a component 200 disposed within the enclosure, and the component 200 may be movable or adjustable within the enclosure to adjust the volume 198 of the chamber. For instance, to reduce the volume 198 of the chamber, the component 200 may be moved toward or more proximate to the port 192.

The HVAC system 150 may include a control system 202 (e.g., the control panel 44, an automation controller, a programmable controller, an electronic controller, a cloud computing system, control circuitry) configured to operate to adjust the volume 198 of the chamber defined by the working fluid reservoir 190. The control system 202 may include a memory 204 (e.g., the non-volatile memory 50) and processing circuitry 206 (e.g., the microprocessor 48). The memory 204 may include volatile memory, such as random-access memory (RAM), and/or non-volatile memory, such as read-only memory (ROM), optical drives, hard disc drives, solid-state drives, or any other non-transitory computer-readable medium that includes instructions (e.g., processor input instructions) for operation. The processing circuitry 206 may be configured to execute such instructions. For example, the processing circuitry 206 may include one or more application specific integrated circuits (ASICs), one or more field programmable gate arrays (FPGAs), one or more general purpose processors, or any combination thereof.

The control system 202 may be communicatively coupled to an actuator 208 configured to drive movement of the component 200 within the working fluid reservoir 190. In some embodiments, the control system 202 may instruct the actuator 208 to move the component 200 within the enclosure to adjust a size of the volume 198 of the chamber based on one or more operating parameters. To this end, the control system 202 may be communicatively coupled to a sensor 210 (e.g., representative of one or more sensors) configured to monitor the operating parameter(s). As an example, the operating parameter(s) may include a temperature of the thermal load 160 relative to a target temperature of the thermal load 160. The control system 202 may determine an operating mode of the HVAC system 150, such as based on the temperature of the thermal load 160 relative to the target temperature of the thermal load 160. For instance, the control system 202 may operate the HVAC system 150 in the cooling load (e.g., by adjusting the reversing valve 172 to the first configuration 186) based on the temperature being greater than the target temperature by a threshold temperature. Additionally, in the cooling load, the control system 202 may instruct the actuator 208 to move the component 200, such as toward the port 192, to reduce the volume 198 of the chamber of the working fluid reservoir 190. In some embodiments, the control system 202 may determine an operating mode of the HVAC system 150 based on a configuration of the reversing valve 172.

As another example, the operating parameter(s) may indicate an efficiency of operation of the HVAC system 150. By way of example, the operating parameter(s) may include a compressor discharge pressure, a compressor suction pressure, a compressor discharge temperature, a compressor suction temperature, a compressor speed, a stage of operation (e.g., a compressor stage), power consumption of the compressor 162 of the HVAC system 150, an operating capacity of the HVAC system 150, a liquid subcooling temperature (e.g., a temperature in which the working fluid is cooled below its saturation temperature, such as via the first heat exchanger 154 in the cooling mode), or any combination thereof. In certain embodiments, the control system 202 may be configured to calculate an efficiency based on a respective value of the operating parameter(s), such as by using an equation or a database table that relates the respective values of the operating parameter(s) to an efficiency value (e.g., based on test data or calibration data provided or determined as a result of previous operations of the HVAC system 150 or of another HVAC system). The control system 202 may instruct the actuator 208 to move the component 200 based on the efficiency value. For example, the control system 202 may instruct the actuator 208 to move the component 200 based on a difference between the efficiency value and a target efficiency value exceeding a threshold value. Thus, the control system 202 may instruct the actuator 208 to move the component 200 to adjust the efficiency value toward the target efficiency value by adjusting an amount of working fluid circulating through the working fluid circuit 152.

As a further example, the operating parameter(s) may indicate a target amount of working fluid circulating through the working fluid circuit 152, and the control system 202 may be configured to calculate the target amount of working fluid based on a respective value of the operating parameter (s) (e.g., via an equation, via a database table). The control system 202 may instruct the actuator 208 to move the component 200 to adjust the amount of working fluid circulating through the working fluid circuit 152 toward the target amount of working fluid.

The control system 202 may also utilize the operating mode in conjunction with a determined efficiency and/or a determined target amount of working fluid to adjust the component 200. For example, in response to determining the HVAC system 150 is to operate in the cooling mode, the control system 202 may instruct the actuator 208 to move the component 200 to a first position 212 (e.g., a first predetermined position) corresponding to the cooling mode. The first position 212 may establish a relatively larger volume 198A of the chamber that is expected to enable desirable operation of the HVAC system 150 (e.g., to achieve a target efficiency value or to achieve a target amount of working fluid circulating through the working fluid circuit 152) in the cooling mode. The control system 202 may then calculate an efficiency value and/or an amount of working fluid circulating through the working fluid circuit 152 (e.g., based on an additional operating parameter) after instructing the actuator 208 to move the component 200 to the first position 212. The control system 202 may further instruct the actuator 208 to move the component 200 based on the calculated efficiency value and/or the calculated current amount of working fluid. In this manner, the control system 202 may initially instruct the actuator 208 to move the component 200 to the first position 212 to establish the relatively larger volume 198A of the chamber, and the control system 202 may instruct the actuator 208 to adjust the component 200 from the first position 212 (e.g., to fine tune the position of the component 200) to change a size of the volume 198 of the chamber from the relatively larger volume 198A to enable the HVAC system 150 to operate more desirably.

Additionally or alternatively, the control system 202 may instruct the actuator 208 to move the component 200 based on a user input. The user input may indicate, for instance, the operating mode and/or an operating parameter. The control system 202 may then instruct the actuator 208 to move the component 200 based on the operating mode and/or the operating parameter indicated by the user input. The user input may additionally or alternatively include a direct indication of a requested position of the component 200. The control system 202 may instruct the actuator 208 to move the component 200 to the requested position indicated by the user input (e.g., regardless of the operating mode and/or an operating parameter).

In some implementations, the working fluid reservoir 190 of the same embodiment or size may be used in different embodiments of the HVAC system 150. For example, a different amount of working fluid may be used for the different embodiments of the HVAC system 150. However, because the size of the volume 198 of the chamber defined by the working fluid reservoir 190 may be adjustable, the working fluid reservoir 190 may accommodate the different amounts of working fluid of the different embodiments of the HVAC system 150 to enable each HVAC system 150 to operate efficiently. As an example, a relatively larger amount of working fluid may be used for a first HVAC system 150, and a relatively smaller amount of working fluid may be used for a second HVAC system 150. However, the same embodiment of the working fluid reservoir 190 may be used for each of the first HVAC system 150 and of the second HVAC system 150. That is, the working fluid reservoir 190 may be configured to store a portion of the relatively larger amount of working fluid to enable the first HVAC system 150 to operate efficiently. Additionally, the working fluid reservoir 190 may be configured to store a portion of the relatively smaller amount of working fluid to enable the second HVAC system 150 to operate efficiently. As such, a single embodiment of the working fluid reservoir 190 may be implemented in multiple, different HVAC system 150 embodiments, thereby reducing a cost and/or complexity associated with usage of the working fluid reservoir 190. For example, manufacture, installation, and/or maintenance of a distinct embodiments of the working fluid reservoir 190 dedicated for implementation in respective, corresponding embodiments of the HVAC system 150 may be avoided.

Figure 6:
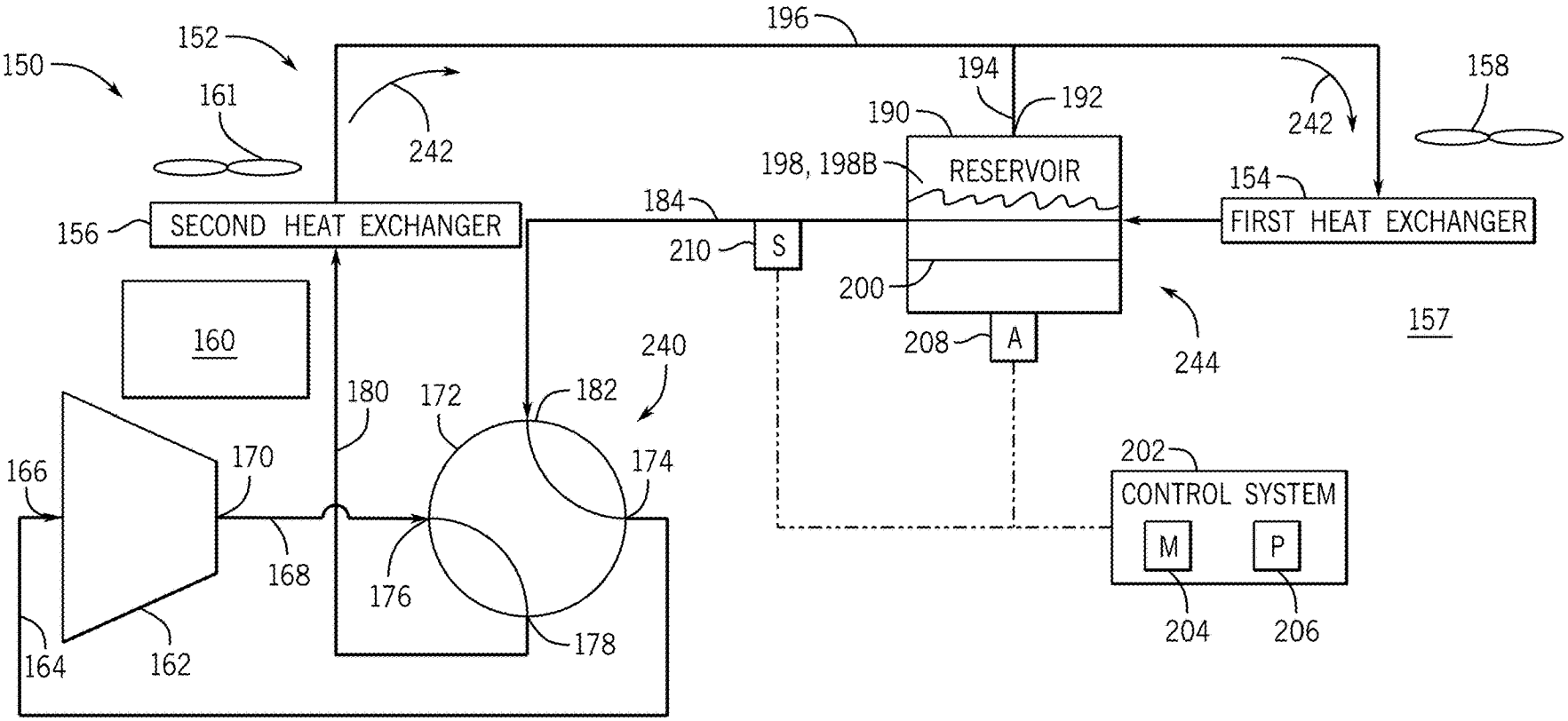
FIG. 6 is a schematic diagram of an embodiment of an HVAC system operating in a heating mode and illustrating a working fluid reservoir of the HVAC system, in accordance with an aspect of the present disclosure.

FIG. 6 is a schematic diagram of an embodiment of the HVAC system 150 operating in a heating mode and including the working fluid reservoir 190. The reversing valve 172 may be in a second configuration 240 in the heating mode of the HVAC system 150. In the second configuration 240, the first port 174 and the fourth port 182 are fluidly coupled to one another and the second port 176 and the third port 178 are fluidly coupled to one another. Accordingly, in the second configuration 240, the reversing valve 172 enables the compressor 162 to receive a flow of working fluid from the first heat exchanger 154 and to discharge a flow of working fluid to the second heat exchanger 156. As such, while the reversing valve 172 is in the second configuration 240, the compressor 162 may direct a working fluid flow along at least a portion of the working fluid circuit 152 in a second flow direction 242 (e.g., opposite the first flow direction 188). For instance, the second configuration 240 of the reversing valve 172 may enable the second heat exchanger 156 to provide heating for the thermal load 160 by transferring heat from the working fluid pressurized by the compressor 162 into the thermal load 160 (e.g., via the air flow directed by the second fan 161 across the second heat exchanger 156). Thus, the second heat exchanger 156 may provide cooling of the working fluid. The first heat exchanger 154 may receive the cooled working fluid from the second heat exchanger 156, provide heating to the working fluid (e.g., via the air flow directed by the first fan 158 across the first heat exchanger 154), and discharge the heated working fluid to the compressor 162 for further pressurization.

Because the working fluid flows from the second heat exchanger 156 to the first heat exchanger 154 in the heating mode, the reservoir conduit 194 is fluidly coupled to the third conduit portion 196 downstream of the second heat exchanger 156 and upstream of the first heat exchanger 156 with respect to a flow of working fluid from the second heat exchanger 156 to the first heat exchanger 154 in the heating mode. Additionally, in the heating mode, the second conduit portion 184 may receive working fluid from the first heat exchanger 154. The temperature of the working fluid flowing through the second conduit portion 184 may be relatively lower in the heating mode relative to the temperature of the working fluid flowing through the second conduit portion 184 in the cooling mode. For example, the relatively lower temperature of the working fluid flowing through the second conduit portion 184 may cool working fluid stored in the working fluid reservoir 190 (e.g., in the volume), thereby reducing a pressure within the working fluid reservoir 190. The reduced pressure within the working fluid reservoir 190 may urge working fluid flow into the working fluid reservoir 190 and out of the working fluid circuit 152. For example, working fluid may flow from the third conduit portion 196, through the reservoir conduit 194, through the port 192, and into the working fluid reservoir 190. As such, in the heating mode, relatively more working fluid may be stored in the working fluid reservoir 190, and relatively less working fluid may circulate through the working fluid circuit 152.

The relatively reduced working fluid flow through the working fluid circuit 152 may enable the HVAC system 150 to achieve a desirable performance, such as a desirable efficiency, in the heating mode. As an example, the second heat exchanger 156 may not be configured to receive working fluid at the relatively greater flow rate from the compressor 162 (e.g., as compared to the first heat exchanger 154 in the cooling mode). Therefore, the second heat exchanger 156 may not efficiently accommodate a relatively high amount of working fluid directed through the working fluid circuit 152 in the heating mode. For instance, an increased amount of working fluid flowing through the working fluid circuit 152 may cause working fluid to be backed up or congested in the second heat exchanger 156. As a result, high discharge pressure and insufficient working fluid flow for providing desirable heating via the second heat exchanger 156 may occur, thereby reducing efficiency of the HVAC system 150.

Thus, the volume 198 of the chamber defined by the working fluid reservoir 190 may be adjusted to further adjust the amount of working fluid circulating through the working fluid circuit 152. For example, in the heating mode, the size of the volume 198 of the chamber may be increased, thereby further enabling flow (e.g., increased flow, as compared to in the cooling mode) of working fluid from the working fluid circuit 152 to the working fluid reservoir 190. The control system 202 may instruct the actuator 208 to move the component 200 away from the port 192 to increase the volume 198 of the chamber in the heating mode. In some embodiments, the control system 202 may instruct the actuator 208 to move the component 200 to a second position 244 (e.g., a second predetermined position) in response to determining the HVAC system 150 is to operate in the heating mode, such as based on the temperature of the thermal load 160 being lower than a target temperature by a threshold temperature. The second position 244 may establish a relatively smaller volume 198B of the chamber expected to enable desirable operation of the HVAC system 150 in the heating mode. The control system 202 may additionally or alternatively calculate an efficiency value and/or an amount of working fluid circulating through the working fluid circuit 152 and instruct the actuator 208 to move the component 200 based on the calculated efficiency value and/or the calculated amount of working fluid circulating through the working fluid circuit 152. For example, the control system 202 may instruct the actuator 208 to adjust the component 200 to the second position 244, thereby adjusting the volume of the working fluid reservoir 190 from the relatively smaller volume 198B, to enable the HVAC system 150 to achieve a desirable efficiency.

Figure 7:
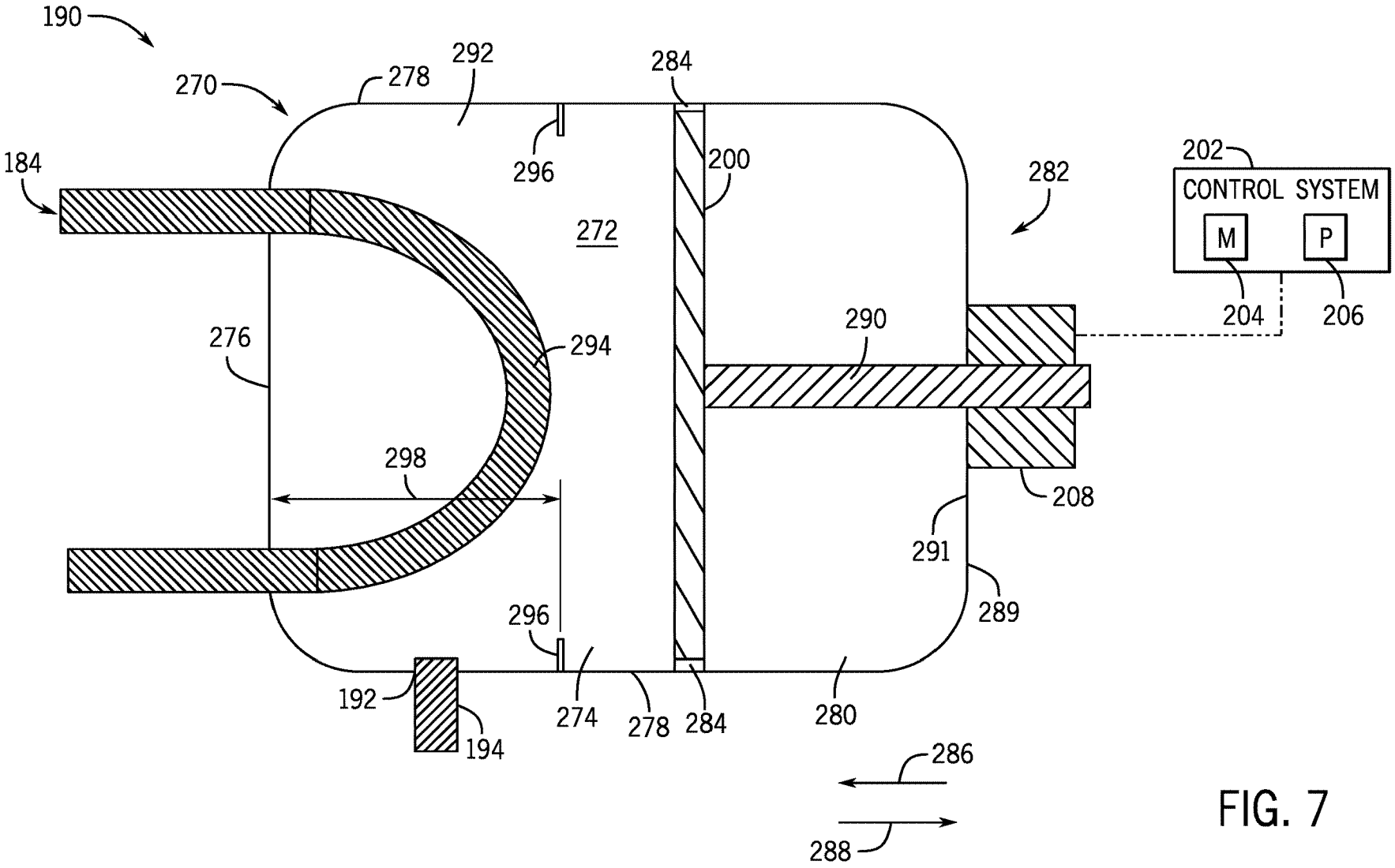
FIG. 7 is a schematic diagram of an embodiment of a working fluid reservoir that may be utilized in an HVAC system, in accordance with an aspect of the present disclosure.

FIG. 7 is a schematic diagram of an embodiment of the working fluid reservoir 190 of the HVAC system 150. The working fluid reservoir 190 includes an enclosure 270 (e.g., a housing, a shell) that defines a chamber 272. The component 200 is disposed within the chamber 272 and may be moved within the chamber 272 to adjust a size of a first volume 274 of the chamber 272. That is, the enclosure 270 and the component 200 may cooperatively define the first volume 274. For example, the first volume 274 may extend between the component 200, an end wall 276 of the enclosure 270, and side walls 278 of the enclosure 270. The port 192 may be fluidly coupled to the first volume 274, such as via one of the side walls 278 and/or the end wall 276, to enable the first volume 274 to receive and store working fluid from the working fluid circuit 152. For instance, the port 192 may be positioned to harness a gravitational force (e.g., in a downward direction crosswise to the side walls 278) to direct working fluid out of the chamber 272.

Moreover, the component 200 may block flow of working fluid from the first volume 274 to a second volume 280 (e.g., a remaining volume) of the chamber 272 extending between the component 200, the side walls 278, and a base wall 282. For example, the component 200 may abut the side walls 278. In some embodiments, seals 284 may be incorporated (e.g., positioned between ends of the component 200 and the side walls 278) to further block flow of working fluid from the first volume 274 to the second volume 280. As such, the working fluid reservoir 190 may contain the stored working fluid within the first volume 274.

In some embodiments, the component 200 may be or include a piston configured to move in a first direction 286 and in a second direction 288, which may be linear directions. For example, the component 200 may be coupled to a shaft 290 (e.g., extending through the second volume 280), and the shaft 290 may be coupled to the actuator 208 (e.g., a motor, a linear actuator). The actuator 208 may drive the shaft 290 to adjust the position of the component 200 within the chamber 272 to adjust respective sizes of the first volume 274 and the second volume 280. The actuator 208 is disposed exterior to the enclosure 270 (e.g., coupled to an exterior surface 289 of the base wall 282) in the illustrated embodiment. However, the actuator 208 may be disposed within the enclosure 270 (e.g., within the second volume 280, coupled to an interior surface 291 of the base wall 282) in additional or alternative embodiments. In embodiments, in which the actuator 208 is disposed within the enclosure 270, the working fluid reservoir 190 may include additional features (e.g., a partition, a divider) that blocks contact between the component 200 and the actuator 208 to maintain desirable operation and/or structural integrity of the actuator 208.

For instance, movement of the component 200 in the first direction 286 toward the port 192 (e.g., toward the end wall 276) may reduce a size of the first volume 274 and increase a size of the second volume 280. Thus, movement of the component 200 in the first direction 286 may reduce the amount of working fluid that may be received from the working fluid circuit 152 and stored in the working fluid reservoir 190. As a result, movement of the component 200 in the first direction 286 may increase the amount of working fluid circulating through the working fluid circuit 152. For example, the control system 202 may instruct the actuator 208 to move the component 200 in the first direction 286 in the cooling mode of the HVAC system 150. Movement of the component in the second direction 288, opposite the first direction 286, away from the port 192 (e.g., toward the base wall 282) may increase the size of the first volume 274 and decrease the size of the second volume 280. As such, movement of the component 200 in the second direction 288 may increase the amount of working fluid that may be received from the working fluid circuit 152 and stored in the working fluid reservoir 190 and thereby reduce the amount of working fluid circulating through the working fluid circuit 152. For example, the control system 202 may instruct the actuator 208 to move the component 200 in the second direction 288 in the heating mode of the HVAC system 150.

Although the illustrated first direction 286 and second direction 288 are linear directions, the component 200 may be configured to move in any other suitable direction in additional or alternative embodiments. As an example, the component 200 may be configured to rotate (e.g., via the actuator 208 that may include a rotary actuator) to adjust respective sizes of the first volume 274 and the second volume 280. As another example, the component 200 may include a flexible material, such as a bladder, that may be inflatable to adjust an amount of space occupied by the component 200 within the chamber 272, thereby adjusting the size of the first volume 274 (e.g., a volume within the chamber 272 that is unoccupied by the component 200), without moving in any designated direction within the chamber 272.

In addition, the second conduit portion 184 may extend into the enclosure 270 and through a portion 292 of the first volume 274 of the chamber 272. In the illustrated embodiment, the second conduit portion 184 includes a bend 294 disposed within the portion 292 of the first volume 274. In additional or alternative embodiments, the second conduit portion 184 may extend linearly or in another suitable manner through the portion 292 of the first volume 274. The working fluid reservoir 190 may also include a barrier 296 (e.g., block, stop, one or more barriers) disposed within the first volume 274 (e.g., extending inwardly from the side walls 278). The barrier 296 may be configured to block movement of the component 200 into the portion 292 of the first volume 274 beyond a predetermined position within the first volume 274. Thus, the barrier 296 may block contact between the component 200 and the second conduit portion 184 extending through the portion 292 of the first volume 274. By way of example, movement of the component 200 in the first direction 286 may otherwise cause the component 200 to abut the barrier 296, and the barrier 296 may block further movement of the component 200 (e.g., beyond the barrier 296) in the first direction 286 to within a threshold distance of the second conduit portion 284. The barrier 296 may therefore also cause the component 200 to be positioned at least a threshold distance 298 away from the end wall 276, thereby establishing a minimum threshold volume of the first volume 274 that is configured to receive and store working fluid.

Each of FIGS. 8 and 9 described below illustrates a respective method for operating the HVAC system 150. In some embodiments, each method may be performed by a single respective component or system, such as by the processing circuitry 206. In additional or alternative embodiments, multiple components or systems may perform the respective steps of each method. It should also be noted that additional steps may be performed with respect to the described methods. Moreover, certain steps of the depicted methods may be removed, modified, and/or performed in a different order. Further still, the respective steps of the methods may be performed in any particular manner relative to one another, such as sequentially or in parallel relative to one another. In some embodiments, one or more steps of the methods described below may be associated with executable instructions stored in the memory 204, and the control system 202 may execute the instructions (e.g., via the processing circuitry 206) to implement one or more of the steps described below.

Figure 8:
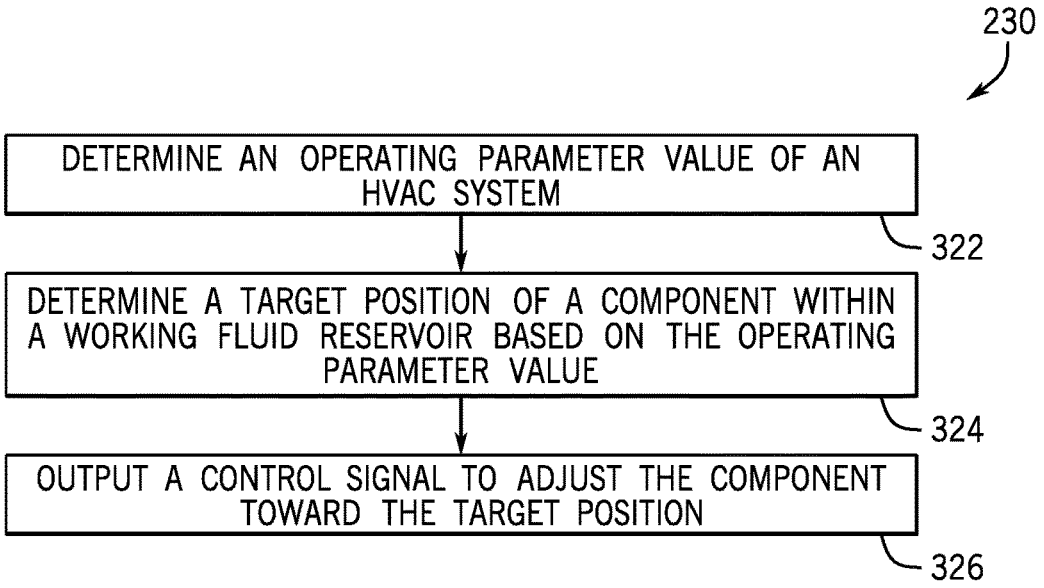
FIG. 8 is a flowchart of an embodiment of a method for operating an HVAC system that includes a working fluid reservoir, in accordance with an aspect of the present disclosure.

FIG. 8 is a flowchart of an embodiment of a method 320 for operating the working fluid reservoir 190 of the HVAC system 150. At block 322, an operating parameter value of the HVAC system 150 may be determined. For example, the operating parameter may be monitored by the sensor 210. The sensor 210 may then transmit data indicative of the operating parameter value, and such data may be used to determine the operating parameter value. The operating parameter value may include a compressor discharge pressure or temperature (e.g., in a heating mode of the HVAC system 150), a compressor suction pressure or temperature, a compressor speed, a stage of operation (e.g., a compressor stage), power consumption of the compressor 162 of the HVAC system 150, an operating capacity of the HVAC system 150, a liquid subcooling temperature, another suitable operating parameter value, or any combination thereof.

At block 324, a target position of the component 200 within the working fluid reservoir 190 may be determined based on the operating parameter value. In some embodiments, an operating mode (e.g., a heating mode, a cooling mode) of the HVAC system 150 may be determined (e.g., determined based on the operating parameter value), and a target position (e.g., the first position 212, the second position 244) corresponding to the operating mode may be determined. In additional or alternative embodiments, an efficiency value of the HVAC system 150 may be determined (e.g., calculated) based on the operating parameter value, and the target position may be determined based on the determined efficiency value. For example, the determined efficiency value may be compared with a target efficiency value, and the target position may be determined in response to a difference between the determined efficiency value and the target efficiency value exceeding a threshold value. In further embodiments, an amount of working fluid to be circulating through the working fluid circuit 152 may be determined (e.g., calculated) based on the operating parameter value, and the target position may be determined based on the amount of working fluid. For instance, the determined amount of working fluid may be compared with a target amount, and the target position may be determined in response to a difference between the determined amount and the target amount exceeding a threshold value.

At block 326, a control signal may be output to adjust the component 200 toward the target position. As an example, the control signal may be output to instruct the actuator 208 to drive movement of the component 200 toward the target position. In some embodiments, the component 200 may include a piston, and the control signal may instruct the actuator 208 (e.g., a motor) to drive the component 200 (e.g., piston) to move in a linear direction toward the target position. Movement of the component 200 toward the target position may adjust the amount of working fluid received by the working fluid reservoir 190 and may thereby adjust the amount of working fluid circulating through the working fluid circuit 152 toward an amount of working fluid more suitable for the particular operation or operating conditions of the HVAC system 150 (e.g., as indicated by the operating parameter value). As such, the HVAC system 150 may operate more efficiently.

It should be noted that the method 320 may be repeatedly (e.g., continually, continuously) performed during operation of the HVAC system 150. That is, an updated operating parameter value may be received, an updated target position of the component 200 may be determined, and a subsequent control signal may be output to adjust the component 200 toward the updated target position. In this manner, the component 200 may be repeatedly adjusted to a more suitable position to enable the HVAC system 150 to operate efficiently. In certain embodiments, a threshold duration of time (e.g., a deadband period of time) may be applied, during which movement of the component 200 may be blocked. For example, after a first control signal is output to adjust the component 200 to a first position, a duration of time may be monitored, and further movement of the component 200 (e.g., away from the first position) may be blocked during the duration of time. After the threshold duration of time has elapsed, output of a second control signal may be enabled to adjust the component 200 from of the first position and to a second position. In this way, constant or excessive adjustment of the component 200 may be avoided to reduce energy that may otherwise be consumed to move the component 200 and/or reduce wear of the working fluid reservoir 190 (e.g., of the component 200) that may occur as a result of constant or excessive movement of the component 200.

Figure 9:
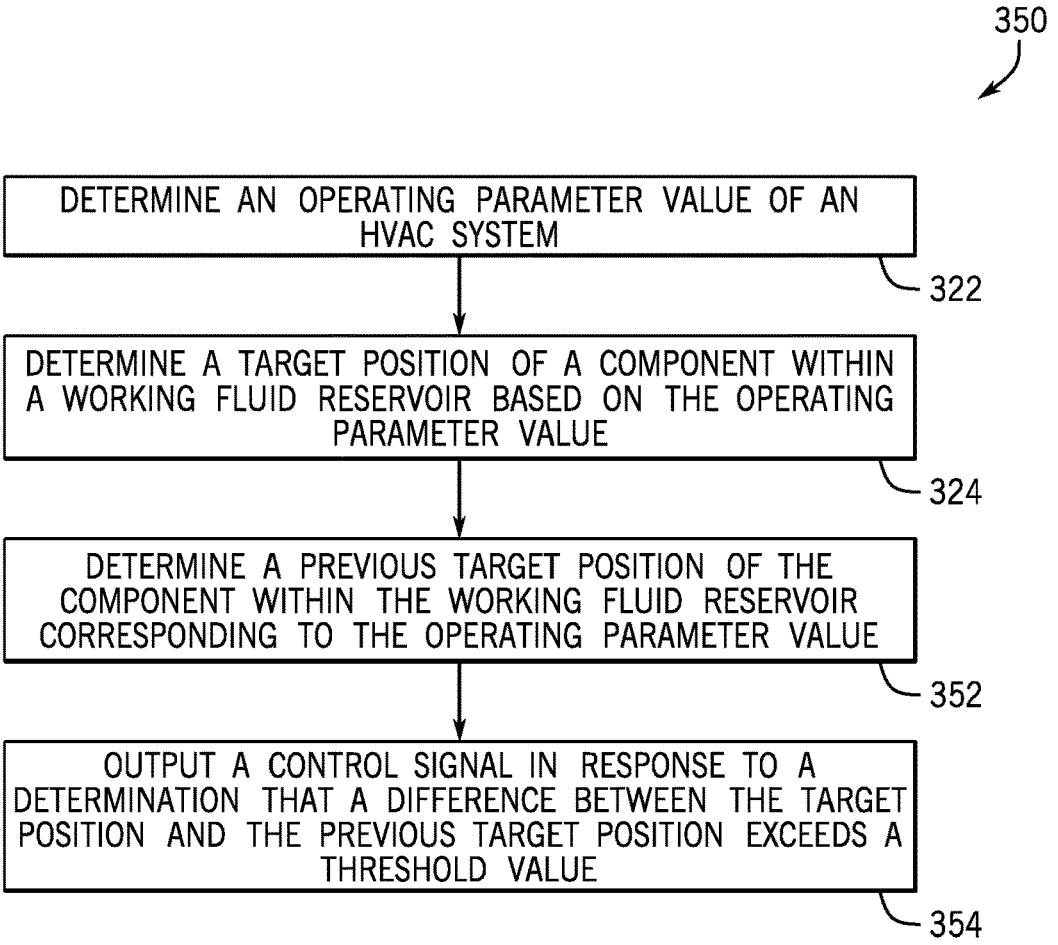
FIG. 9 is a flowchart of an embodiment of a method for operating an HVAC system that includes a working fluid reservoir, in accordance with an aspect of the present disclosure.

FIG. 9 is a flowchart of an embodiment of a method 350 for operating the HVAC system 150. At block 322, an operating parameter value of the HVAC system 150 may be determined in accordance with the techniques described herein (e.g., via the sensor 210, via a user input). At block 324, a target position of the component 200 of the working fluid reservoir 190 may be determined based on the operating parameter value using the techniques described herein.

At block 352, a previous target position of the component 200 corresponding to the operating parameter value may be determined. As an example, the same operating parameter value may have previously been detected by the sensor 210 during a different time of operation (e.g., a different cycle of operation) of the HVAC system 150, and the previous target position of the component 200 may have previously been determined to enable efficient operation of the HVAC system 150 at the different time of operation. The target position of the component 200 determined at block 324 may then be compared with the previous target position.

At block 354, a control signal may be output in response to a determination that a difference between the target position of the component 200 and the previous target position of the component 200 exceeds a threshold value. For instance, the difference between the target position of the component 200 and the previous target position of the component 200 exceeding a threshold value may indicate the current operation or condition of the HVAC system 150 is undesirable. By way of example, a first efficiency may have previously been calculated based on a particular operating parameter value, and the previous target position of the component 200 may have been determined based on the first efficiency. A second efficiency may be calculated based on the same operating parameter value detected at a later time, and the target position of the component 200 may be determined based on the second efficiency. However, the second efficiency may be lower than the first efficiency, thereby indicating a decrease in the determined efficiency of the HVAC system 150 at the same operating parameter value. The decreasing efficiency of the HVAC system 150 may not be desirable. Therefore, the control signal may be output to address the decreasing efficiency or other operating condition indicated by a difference between the target position and the previous target position that is greater than a threshold difference.

For instance, the difference between the target position of the component 200 and the previous target position of the component 200 exceeding the threshold value (e.g., to indicate a decreasing efficiency of the HVAC system 150) may indicate undesirable flow of working fluid (e.g., flow of working fluid out of the working fluid circuit 152), undesirable (e.g., faulty) operation of a component of the HVAC system 150, and so forth. In some circumstances, continued operation of the HVAC system 150 may not be desirable (e.g., may affect a structural integrity of a component of the HVAC system 150). Thus, in some embodiments, the control signal may be output to suspend operation of the HVAC system 150. In additional or alternative embodiments, the control signal may be output to provide a notification to a user, such as a technician, an occupant, and/or an operator. For example, the control signal may cause the HVAC system 150 to provide a visual output, a sound output, and/or a display output and/or may transmit a notification to a mobile device (e.g., a phone, a tablet, a mobile computer) of the user. As such, the control signal may prompt the user to address the operation of the HVAC system 150. In this manner, operation of the HVAC system 150 may be more suitably addressed based on historical data that includes previously determined target positions of the component 200.

The present disclosure may provide one or more technical effects useful in the operation of an HVAC system. For example, the HVAC system may include a working fluid circuit through which working fluid may circulate. The HVAC system may also include a reservoir configured to receive and store working fluid from the working fluid circuit. The reservoir may include a component configured to move within the reservoir to adjust an amount of working fluid that may be received and stored in the reservoir. As such, movement of the component within the reservoir may adjust an amount of working fluid that may circulate through the working fluid circuit. In some embodiments, the HVAC system may include a control system configured to adjust the position of the component based on an operating parameter. For example, the control system may adjust the position of the component to reduce the amount of working fluid that may be stored in the reservoir in a cooling mode, and the control system may adjust the position of the component to increase the amount of working fluid that may be stored in the reservoir in a heating mode. Such movement of the component may enable a more suitable amount of working fluid to circulate through the working fluid circuit to enable the HVAC system to operate more efficiently. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and air conditioning (HVAC) system, comprising:

a working fluid circuit comprising a first conduit portion extending from a compressor to a first heat exchanger, a second conduit portion extending from the first heat exchanger to a second heat exchanger, and a third conduit portion extending from the second conduit portion, wherein the first conduit portion is configured to direct working fluid from the compressor to the first heat exchanger in a cooling mode of the HVAC system;

a working fluid reservoir comprising an enclosure defining a chamber fluidly coupled to the second conduit portion of the working fluid circuit via the third conduit portion of the working fluid circuit, wherein the chamber is configured to receive and store working fluid from the third conduit portion of the working fluid circuit, wherein the first conduit portion extends through a portion of the chamber and is configured to place working fluid flowing through the first conduit portion in a heat exchange relationship with working fluid within in the chamber to cause flow of working fluid from the second conduit portion to the chamber via the third conduit portion in a heating mode of the HVAC system;

an actuator configured to adjust a component disposed within the enclosure to adjust a volume of the chamber; and a control system configured to instruct the actuator to adjust a position of the component disposed within the enclosure to increase the volume of the chamber, to reduce the volume of the chamber, or both based on an operating mode of the HVAC system.

2. The HVAC system of claim 1, wherein the operating mode comprises the heating mode or the cooling mode.

3. The HVAC system of claim 1, wherein the component is a piston, the actuator comprises a shaft coupled to the piston, the piston and the enclosure define the volume of the chamber, and the actuator is coupled to the shaft and is configured to drive the shaft to adjust the position of the piston within the enclosure and to adjust the volume of the chamber.

4. The HVAC system of claim 3, wherein the enclosure comprises a barrier disposed within the chamber and configured to block movement of the piston into the portion of the chamber.

5. The HVAC system of claim 1, wherein the actuator comprises a motor.

6. The HVAC system of claim 1, wherein the control system is configured to:

receive an operating parameter indicative of an efficiency of the HVAC system; and instruct the actuator to adjust the position of the component to adjust the volume of the chamber based on the operating parameter.

7. The HVAC system of claim 6, wherein the operating parameter comprises a compressor discharge pressure, a compressor suction pressure, a compressor discharge temperature, a compressor suction temperature, a compressor speed, a stage of operation, power consumption of the compressor of the HVAC system, an operating capacity of the HVAC system, a liquid subcooling temperature, or any combination thereof.

8. A heating, ventilation, and air conditioning (HVAC) system, comprising:

a working fluid circuit comprising a first conduit portion extending from a compressor to a first heat exchanger, a second conduit portion extending from the first heat exchanger to a second heat exchanger, and a third conduit portion extending from the second conduit portion, wherein the first conduit portion is configured to direct working fluid from the compressor to the first heat exchanger in a cooling mode of the HVAC system;

a working fluid reservoir comprising an enclosure and a component disposed within the enclosure, wherein the enclosure defines a chamber fluidly coupled to the second conduit portion of the working fluid circuit via the third conduit portion, the chamber is configured to receive, via the third conduit portion, working fluid from the second conduit portion of the working fluid circuit, the enclosure is configured to store working fluid within the chamber, and the component is adjustable within the chamber to adjust a volume of the chamber, wherein the first conduit portion extends through the chamber and is configured to place working fluid flowing through the first conduit portion in a heat exchange relationship with working fluid within in the chamber to cause flow of working fluid from the chamber to the second conduit portion via the third conduit portion in the cooling mode of the HVAC system and to cause flow of working fluid from the second conduit portion to the chamber via the third conduit portion in a heating mode of the HVAC system; and a control system configured to:

instruct an actuator to move the component within the enclosure to reduce the volume of the chamber in the cooling mode of the HVAC system; and instruct the actuator to move the component within the enclosure to increase the volume of the chamber in the heating mode of the HVAC system.

9. The HVAC system of claim 8, wherein the first conduit portion comprises a bend disposed within the chamber.

10. The HVAC system of claim 8, wherein the enclosure comprises a barrier disposed within the chamber and configured to block contact between the component and the first conduit portion.

11. The HVAC system of claim 8, wherein the working fluid reservoir comprises a port configured to fluidly couple the chamber to the third conduit portion of the working fluid circuit, and the control system is configured to:

instruct the actuator to move the component toward the port to reduce the volume of the chamber in the cooling mode of the HVAC system; and instruct the actuator to move the component away from the port to increase the volume of the chamber in the heating mode of the HVAC system.

12. The HVAC system of claim 8, wherein the control system is configured to:

receive data indicative of an operating parameter of the HVAC system;

determine a target position of the component based on the operating parameter; and instruct the actuator to move the component toward the target position.

13. A non-transitory computer-readable medium, comprising instructions that, when executed by processing circuitry, are configured to cause the processing circuitry to:

determine an operating mode of a heating, ventilation, and air conditioning (HVAC) system, wherein the HVAC system comprises a working fluid circuit configured to circulate working fluid therethrough, wherein the operating mode comprises a heating mode or a cooling mode;

instruct an actuator to adjust a position of a component disposed within an enclosure of a working fluid reservoir of the HVAC system based on the operating mode to adjust a volume of a chamber defined by the enclosure, wherein the chamber is fluidly coupled to the working fluid circuit, and the volume of the chamber is configured to receive and store working fluid from the working fluid circuit;

adjust a reversing valve to direct working fluid along the working fluid circuit in a first flow direction in the cooling mode; and adjust the reversing valve to direct working fluid along the working fluid circuit in a second flow direction, opposite the first flow direction, in the heating mode.

14. The non-transitory computer-readable medium of claim 13, wherein the instructions, when executed by the processing circuitry, are configured to cause the processing circuitry to:

determine an efficiency of the HVAC system; and instruct the actuator to adjust the position of the component to adjust the volume of the chamber based on the efficiency.

15. The non-transitory computer-readable medium of claim 13, wherein the instructions, when executed by the processing circuitry, are configured to cause the processing circuitry to:

instruct the actuator to adjust the position of the component in a first direction to increase the volume of the chamber in the heating mode; and instruct the actuator to adjust the position of the component in a second direction, opposite the first direction, to reduce the volume of the chamber in the cooling mode.

16. The non-transitory computer-readable medium of claim 13, wherein the instructions, when executed by the processing circuitry, are configured to cause the processing circuitry to:

instruct the actuator to adjust the position of the component to an updated position to adjust the volume of the chamber to an updated volume; and maintain the updated position of the component for a threshold duration of time to maintain the updated volume of the chamber for the threshold duration of time after instructing the actuator to adjust the position of the component to the updated position.

17. The non-transitory computer-readable medium of claim 13, wherein the instructions, when executed by the processing circuitry, are configured to cause the processing circuitry to:

receive an operating parameter value of the HVAC system;

determine a target position of the component based on the operating parameter value;

determine a previous target position of the component corresponding to the operating parameter value; and output a control signal in response to a determination that a difference between the target position and the previous target position exceeds a threshold value.

18. The non-transitory computer-readable medium of claim 17, wherein the instructions, when executed by the processing circuitry, are configured to cause the processing circuitry to output the control signal to suspend operation of the HVAC system, provide a notification to a user, or both in response to the determination that the difference between the target position and the previous target position exceeds the threshold value.

* * * * *